US010395907B2

(12) United States Patent
Alava et al.

(10) Patent No.: US 10,395,907 B2
(45) Date of Patent: Aug. 27, 2019

(54) MEMS DEVICE FOR GENERATING AN ION BEAM

(71) Applicant: COMMISSARIAT A L'ENERGIE ATOMIQUE ET AUX ENERGIES ALTERNATIVES, Paris (FR)

(72) Inventors: Thomas Alava, Grenoble (FR); Hadley Videlier, Grenoble (FR); Frederic Progent, Paris (FR); Laurent Duraffourg, Voiron (FR); Sebastien Vigne, Issy les Moulineaux (FR); Romain Mahieu, Saint-Lo (FR)

(73) Assignee: COMMISSARIAT A L'ENERGIE ATOMIQUE ET AUX ENERGIES ALTERNATIVES, Paris (FR)

( * ) Notice: Subject to any disclaimer, the term of this patent is extended or adjusted under 35 U.S.C. 154(b) by 0 days.

(21) Appl. No.: 15/903,321

(22) Filed: Feb. 23, 2018

(65) Prior Publication Data

US 2018/0254175 A1 Sep. 6, 2018

(30) Foreign Application Priority Data

Feb. 27, 2017 (FR) ..... 17 51540

(51) Int. Cl.
*H01J 49/14* (2006.01)
*H01J 27/20* (2006.01)
(Continued)

(52) U.S. Cl.
CPC ..... *H01J 49/0018* (2013.01); *H01J 27/024* (2013.01); *H01J 27/20* (2013.01); *H01J 49/14* (2013.01); *H01J 49/26* (2013.01)

(58) Field of Classification Search
CPC ..... H01J 49/0018; H01J 49/14; H01J 49/147; H01J 27/20; H01J 27/205
See application file for complete search history.

(56) References Cited

U.S. PATENT DOCUMENTS 5,401,963 A 3/1995 Sittler
2005/0199805 A1 9/2005 Freidhoff
(Continued)

FOREIGN PATENT DOCUMENTS

EP 1 826 809 A1 8/2007
WO WO 2007/102224 A1 9/2007

OTHER PUBLICATIONS

Yoon et al. 'Fabrication of two types of micro ion sources for a micro timer-of-flight mass spectrometer', Jul. 5, 2007, J Micromech. Microeng. 17, 1542-1548.*
(Continued)

*Primary Examiner* — Eliza W Osenbaugh-Stewart
(74) *Attorney, Agent, or Firm* — Oblon, McClelland, Maier & Neustadt, L.L.P.

(57) ABSTRACT

A generator of an ion beam is provided, including an ionization chamber provided with an inlet of a fluid to be ionized; a source of ionizing particles configured to impact the fluid in an impact zone of the ionization chamber so as to generate ions; and an extractor of ions generated in a direction of an outlet zone of the generator, the extractor including at least two electrodes, a first electrode referred to as input electrode laterally bordering the impact zone, and at least one second electrode referred to as intermediate electrode located in the impact zone, the at least two electrodes being configured to generate a voltage gradient in the impact zone, with the voltage gradient being configured to direct the generated ions to the outlet zone of the generator.

18 Claims, 8 Drawing Sheets

(51) Int. Cl.

| | |
|---|---|
| ***H01J 49/00*** | (2006.01) |
| ***H01J 27/02*** | (2006.01) |
| ***H01J 49/26*** | (2006.01) |

(56) References Cited

U.S. PATENT DOCUMENTS

| | | | |
|---|---|---|---|
| 2007/0262263 | A1 | 11/2007 | Kruit et al. |
| 2009/0090862 | A1 | 4/2009 | Kawana et al. |

OTHER PUBLICATIONS

French Preliminary Search Report dated Oct. 20, 2017 in French Application 17 51540 filed on Feb. 27, 2017 (with English Translation of Categories of Cited Documents and Written Opinion).

Charles-Marie Tassetti, et al., "A MEMS electron impact ion source integrated in a microtime-of-flight mass spectrometer," Sensors and Actuators B: Chemical: International Journal Devoted to Research and Development of Physical and Chemical Transducers, vol. 189, 2013, pp. 173-178.

Todd T. King, et al., "Simulation of a Miniature, Low-Power Time-of-Flight Mass Spectrometer for In Situ Analysis of Planetary Atmospheres," Proceedings of SPIE, vol. 6959, 2008, pp. 069590E-1 to 069590E-15.

Richard R.A. Syms, et al., "MEMS mass spectrometers: the next wave of miniaturization," Journal of Micromechanics and Microengineering, vol. 26, No. 2, 2016, pp. 1-28.

Andrew Malcolm, et al., "A miniature mass spectrometer for liquid chromatography applications," Rapid Communications in Mass Spectrometry vol. 25, 2011, pp. 3281-3288.

Eric Wapelhorst, et al., "Complex MEMS: a fully integrated TOF micro mass spectrometer," Sensors and Actuators A, vol. 138, 2007, pp. 22-27.

* cited by examiner

MEMS DEVICE FOR GENERATING AN ION BEAM

FIELD OF THE INVENTION

This invention relates in general to devices, for generating ion beams. One non-limiting application is conventional mass spectrometry, using a beam generator as the first operational portion, in order to create an ion beam to be analysed. Other applications are however targeted, in particular in the field of secondary ion mass spectroscopy.

From a manufacturing standpoint, the invention can allow for the use of microelectronics techniques in such a way as to implement the beam generator (and possible other components) in a micro or nano electromechanical device (corresponding to the term MEMS or NEMS).

TECHNOLOGICAL BACKGROUND

Mass spectrometers are powerful scientific instruments that allow for chemical and biological analyses in such a way as to determine compositions. Usually, these apparatuses are relatively massive and typically intended for use in the laboratory. Efforts however have been made in terms of compactness and portability without however giving full satisfaction.

Patent publication US2009/0090862 A1 presents in this context a mass spectrometer seeking to limit the footprint of this device. FIG. 1 of this anteriority is reproduced in FIG. 1 of the drawings. An enclosure is presented therein wherein a fluid to be analysed can be introduced by a capillary tube that opens, inside the enclosure, into an ion generator G visible on the left side of the figure. The latter forms a chamber inside of which electrons, here produced by a substantially heated filament F, are bombarded in such a way as to impact, in a certain proportion, the molecules of the fluid to be analysed. As the impacts occur, ions are therefore produced. The following steps of the method of spectrometry take advantage of the electric charge of these ions. Firstly, at the outlet of the ion generator G, the latter undergo an electromagnetic attraction by an extractor E comprising a plurality of electromagnetic lenses. Passing through the lenses, the ions are progressively oriented and accelerated.

An electromagnetic discrimination device is then configured to influence differently according to their mass the ions to a detector D at the end of the mass spectrometry analysis chain, on the right side of FIG. 1. The electromagnetic discrimination device, conjugated with the detector D, can for example assess the types of ions according to their flight time to the detector or according to their impact zone on this detector.

However, such a device does not allow for an optimum extraction of ions.

It is therefore an object of the invention to overcome at least in part the disadvantages of the current techniques.

SUMMARY OF THE INVENTION

A non-limiting aspect of the invention relates to an ion beam generator, comprising:

- an ionisation, chamber provided with an inlet of a fluid to be ionised,
- a source of ionising particles configured to impact the fluid in an impact zone of the ionisation chamber in such a way as to generate ions,
- an extractor of ions generated in the direction of an outlet zone of the generator.

Advantageously, it comprises at least two electrodes configured to generate a voltage gradient in the impact zone, with the voltage gradient tending to direct the ions generated to the outlet zone of the generator.

According to a preferred embodiment, the extractor comprises a first electrode referred to as input electrode laterally bordering the impact zone, and at least one second electrode referred to as intermediate electrode located in said impact zone.

As such, the extraction of the ions is produced according to a path that is as short as possible as soon as they are generated. The desired direction for the exit of the ions is applied right from the ionisation phase, contrary to prior art, wherein the ions are first directed rather randomly according to the impact of the ionising particle, then reoriented by the extractor, outside the ionisation chamber. This results in that the recovery rate of ions at the outlet of the generator is improved.

Another separable aspect of this invention relates to a mass spectrometer provided with such a generator. A method of manufacturing is also covered.

BRIEF INTRODUCTION OF THE FIGURES

Other characteristics, purposes and advantages of this invention shall appear when reading the following detailed description, with respect to the annexed drawings, provided as non-limiting examples, and wherein:

FIG. 1 diagrammatically shown a mass spectrometer according to prior art;

FIG. 2 diagrams an example installation of an ion generator in a more complex device;

Figure 1:
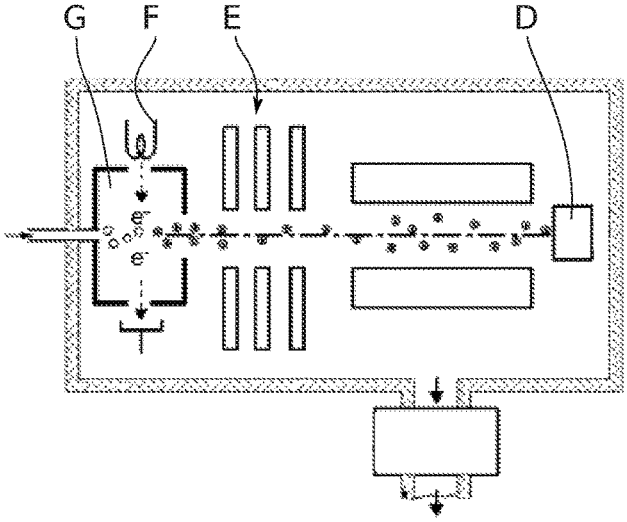

FIGS. 9*a* to 9*m* show successive steps of manufacture of a device according to the invention based on microelectronics techniques.

The drawings are given by way of examples and do not limit the invention. They form block diagrams intended to facilitate the understanding of the invention and are not necessarily to the scale of the practical applications.

DETAILED DESCRIPTION

Before beginning a detailed review of embodiments of the invention, hereinafter are mentioned optional characteristics that can possible be used according to any association or alternatively:

- the extractor comprises at least one electrode 5*a*, 5*b* located in the impact zone 9;
- the extractor comprises a plurality of electrodes 5*a*, 5*b* located in the impact zone 9;
- the source of ionising particles is configured to bombard ionising particles in the ionisation chamber 10 between at least two electrodes 5*a*, 5*b;*
- all of the electrodes 5*a*, 5*b* of the extractor are located in the impact zone 9;
- the source of ionising particles is configured to generate a flow of ionising particles with a transverse direction, and preferably perpendicular, to a direction of extraction of the ions generated;

the extractor comprises a full input electrode 5*a* comprising at least one passage forming the inlet of the ionisation chamber 10;

at least one passage of the input electrode 5*a* is passed through by a tube 2 for injecting fluid into the ionisation chamber 10;

the extractor comprises an output electrode 5*c* comprising a passage 55 forming the outlet zone;

the dimension of the output electrode 5*c* along a direction of extraction of the ions generated is greater than that of at least one other electrode of the plurality of electrodes 5*a*, 5*b*, 5*c;* at least one electrode 5*a*, 5*b*, 5*c* comprises a first portion 52, a second portion 53 and two pillars 51 joining the first portion 52 and the second portion 53;

at least one of the two pillars 51 is electrically conductive;

at least one among the first portion 52 and the second portion 53 is at least partially conductive;

at least one among the first portion 52 and the second portion 53 connects the two pillars and advantageously said portion is conductive between the two pillars 51;

a first substrate 31 and a second substrate 21 are assembled by one of their respective faces;

the first portion 52 is carried by the first substrate 31 and the second portion 53 is carried by the second substrate 21;

at least one among the first substrate 31 and the second substrate 21 has a semi-conductor material base.

Possibly, the following options are also possible:

one at least among the first portion and the second portion consists in a coating of a distal face of at least one of the two pillars.

at least one among the first portion 52 and the second portion 53 extends between the two pillars 51;

at least one of the two pillars 51 has a circular or square or rectangular section.

at least one of the two pillars 51 is formed from an element of material that also forms at least partially one among the first portion 52 and the second portion 53.

the at least one among the first portion 52 and the second portion 53 which extends between the two pillars 51 comprises, for each pillar, a portion for connection to the pillar and, between the two connection portions, an intermediate portion, with the intermediate portion being of a section less than that of the connection portions.

It is specified that, in the framework of this invention, the term "on" or "above" does not necessarily mean "in contact with". As such, for example, the deposition of a layer on another layer does not necessarily means that the two layers are directly in contact with one another but this means that one of the layers covers at least partially the other by being either directly in contact with it, or by being separated from it by a film, another layer or another element. One layer can moreover be comprised of several sublayers of the same material or of different materials.

The term intermediate position means a position strictly comprised between a first position and a second position.

In particular in what follows, the first and second positions correspondent respectively to a first end and to a second end of the extractor, more preferably in the plane XY and according to the direction X of the orthonormal coordinate system attached to the figures.

It is specified that in the framework of this invention, the thickness of a layer or of a substrate is measured according to a direction perpendicular to the surface according to which this layer or this substrate has its maximum extension. The thickness is taken in particular according to the direction Z of the orthonormal coordinate system attached to the figures.

Certain portions of the device of the invention can have an electrical function. Some are used for electrical conduction properties and the term electrode or equivalent means elements formed from at least one material that has sufficient conductivity, in the application, to carry out the desired function.

Figure 2:
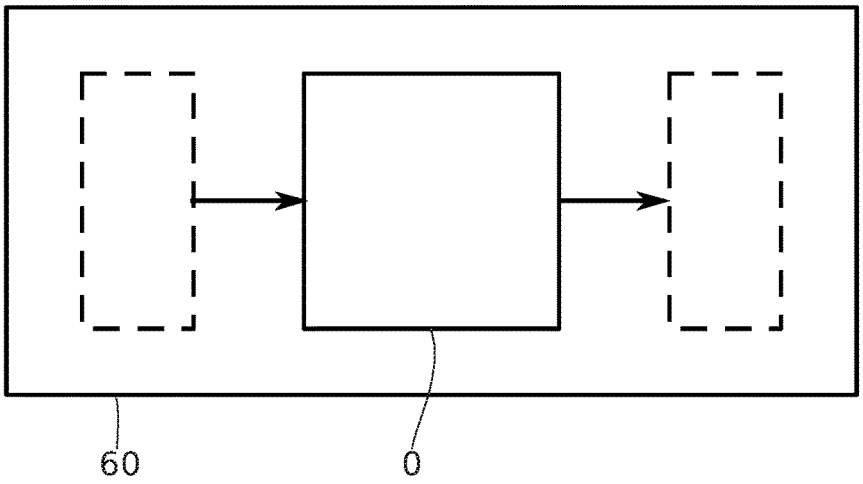

The ion generator 0 can be implemented in a more general device, in particular a mass spectrometer. This is shown highly diagrammatically in FIG. 2 with an enclosure defining the volume of the mass spectrometer 60, the latter incorporating a generator 0. In this illustration, the generator 0 is in interaction upstream, with a portion of the generation of a fluid sample containing molecules or atoms to be analysed and, downstream, with an analysis device, comprising for example means for applying an electromagnetic field intended to accelerate and/or to divert ions in the direction of a detector. Detections via discrimination of the flight time or of the location of impact on the sensitive portion of the detector can be implemented. Thanks to the invention, the operations of ionisation and of extraction of ions are produced in an optimised manner.

Figure 3:
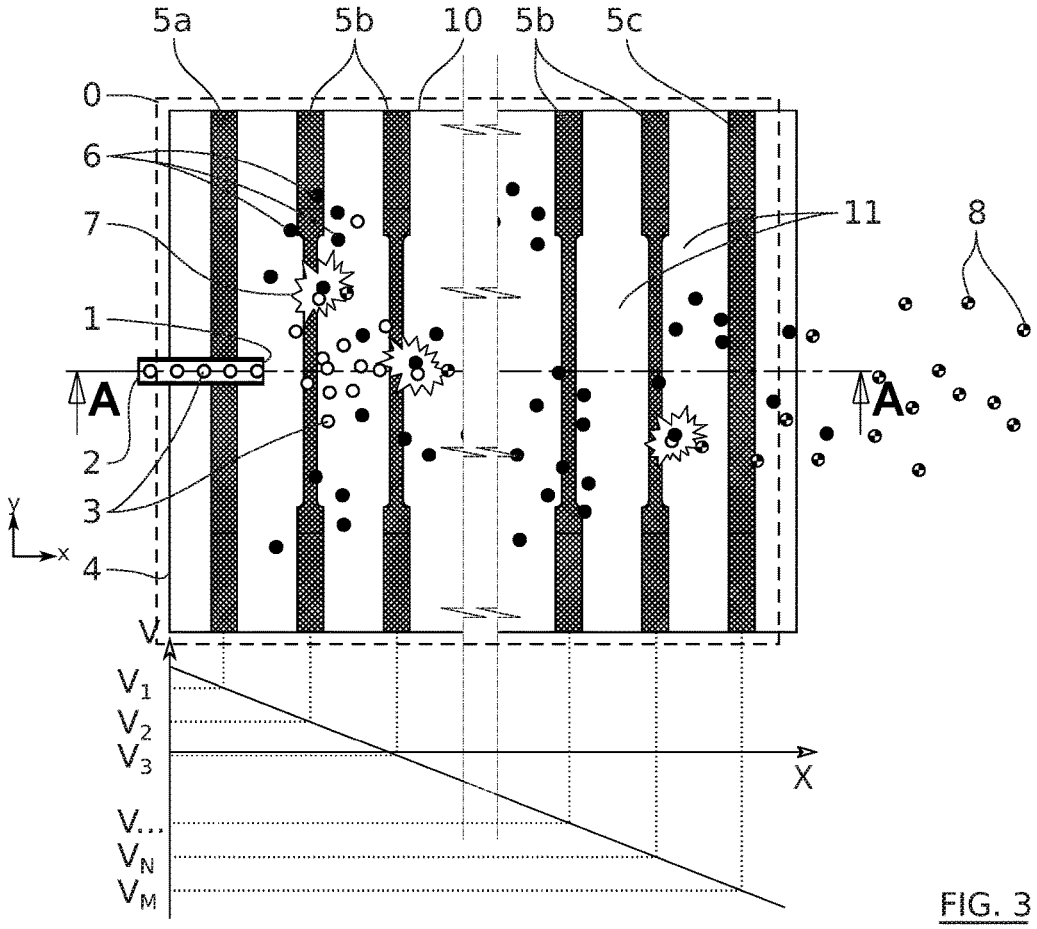
FIG. 3 shows a top view of an embodiment of an ion generator according to the invention and an example of a voltage gradient in this generator.

An example of an ion generator 0 that makes it possible to obtain the result of the invention is shown as a top view (corresponding to a plane XY in the coordinate system indicated) in FIG. 3. The direction X corresponds to the direction of extraction of the ions while the direction Y corresponds to the width of the generator. FIG. 3 shows an inlet 1 for fluid (typically in the gaseous state), for example through a capillary tube 2 in such a way as to bring molecules and/or atoms 3 of the fluid to be analysed inside the generator. The illustrations show a single capillary tube 2 but their number is not limited and several tubes, in particular parallel, can be implemented in order to allow either for a larger quantity of fluid or the same quantity of fluid with a lesser flow rate, in the ionisation chamber 10 defined on the ion generator.

Conventionally, ionisation consists in electrically charging molecules and/or atoms present in the fluid to be analysed, with the electric charge then making it possible to influence the ions generated thanks to electric fields to operate for example an acceleration and/or detection operations. The step of ionisation is diagrammatically shown in FIG. 3 by impacts 7 on which a molecule or atom 3 encounters an electrically charged particle 6, for example an electron. For this purpose, the generator comprises a source S of ionising particles configured to bombard an impact zone 9 of the generator, with the impact zone 9 corresponding to a portion of the inside space of the generator on which the molecules and/or atoms introduced are able to interfere with the particles bombarded by the source S.

Figure 4:
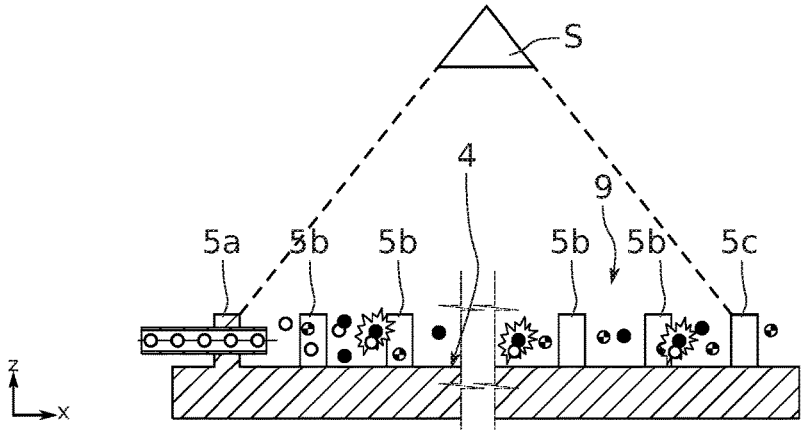
FIG. 4 is a profile view of FIG. 3.

FIG. 4 shows in dotted lines an example of an end of a beam of ionising particles along a direction corresponding to the section A-A of FIG. 3 and to the plane XZ of the aforementioned coordinate system. Such a beam can be produced by a source S in the form of an electron gun, in particular of the heated filament type forming a first electrode of the source S and generating free electrons, with the latter then being directed, more preferably with a high kinetic energy, to a second electrode forming the anode of the electromagnetic device of the source. Although this is not limiting, said second electrode can be formed by any or a portion of a base portion 4 of the generator. For example, the generator can be at least partially formed from a first substrate of which the upper face forms the base 4, with the latter able to be at least partially electrically conductive and a suitable potential place and configured to form the attraction of the free electrons, in such a way as to produce the bombardment of these electrons in the impact zone 9 interfering with the path of circulation of the fluid sample to be analysed. A portion at least of the electrodes that shall be described later can also be used to constitute the anode of the source of particles.

Generally, it is preferable that the average direction of the particles charged during the bombardment be transversal, and preferably perpendicular, to an average direction of the path of the molecules and/or of atoms in the generator, in particular along the direction of extraction represented here by the axis X. Preferably, the average direction of bombardment is also perpendicular to the base 4 of the generator (typically a face of a participating substrate in the generator), while the extraction of the ions 8 is operating in the base plane 4.

The ionising particles 6 can also be photons or ions.

Thanks to this principle of ionisation via impact, ions 8 are generated. Note that these steps are advantageously produced in an enclosure wherein a depression is applied in such a way as to favour the evolution of the ions 8, and also the fluidic sample, to a direction downstream from the generator.

Characteristically, within the impact zone 9 on which the ionisation is produced, voltage gradient is furthermore applied configured to immediately influence the ions generated in such a way that it is directed to an outlet zone of the generator. In the case of FIG. 3, the outlet zone corresponds to the right end of the illustration. Typically, still in this example, the voltage gradient in question will tend to direct the ions 8 along the direction X.

To achieve this, a plurality of electrodes 5*a, b, c* are used configured to generate the voltage gradient, advantageously linear. Preferably, the voltage gradient is strictly oriented along the X axis. The generator can include a programmable circuit with several control outlets each able to set the potential of an electrode.

While it could have been thought that the presence of electrodes was incompatible with the ionisation phase, as the electrodes are able to constitute obstacles to the bombardment of charged particles, this invention offers a solution in this unexpected direction, including, in a preferred embodiment, by placing electrodes all or in part in the impact zone 9.

This is the case in the example given in FIGS. 3 and 4 for which the plurality of electrodes firstly comprises an input electrode 5*a*. The latter is at least partially electrically conductive and configured to receive the application of a predetermined electrical potential V1. Preferably, this electrode is furthermore full except in the zone or zones through which it operates the introduction of the fluid sample. Typically, the input electrode 5*a* can be in the form of a full bar simply passed through by one or several capillary tubes 2. Advantageously, the input electrode 5*a* borders the generator by one of its sides by defining a lateral border of the impact zone 9. This input electrode 5*a* constitutes more preferably a first end of the extractor according to X.

The plurality of electrodes furthermore advantageously comprises at least one other electrode which can in particular be an intermediate electrode 5*b*.

Advantageously, the space between the electrodes 5*a*, 5*b* and 5*c* is constant.

In the case shown, an intermediate electrode 5*b* follows the input electrode 5*a* along the direction X and can be parallel to it. According to the configuration shown, the electrodes 5*b* have a passage 55, visible more precisely in FIG. 5, that allows for the extraction of ions 8 at their level.

The plurality of electrodes also comprises more preferably an output electrode 5*c*. The passage 55 of the latter corresponds to the outlet zone of the ions 8.

This output electrode 5*c* more preferably constitutes a second end of the extractor according to X. Preferably, the surface of the electrode 5*c* is more substantial than that of the intermediate electrodes 5*b*.

The intermediate electrodes 5*b* are advantageously located between the first and second ends of the extractor. They are more preferably distributed in a portion of space between the input electrode 5*a* and the output electrode 5*c*. This portion of space is more preferably strictly comprised according to X between the input 5*a* and output 5*c* electrodes.

The distribution of the intermediate electrodes 5*b* can be periodical. In this case, the electrostatic potential assigned to each electrode can be granted in such a way as to accelerate or decelerate the ions along X.

The distribution of the intermediate electrodes 5*b* can be such that the pitch between each electrode 5*b* is variable according to X. In particular, this pitch can decrease regularly or increase regularly according to X. In this case, the electrostatic potential assigned to each electrode can be constant in such a way as to accelerate or decelerate the ions along X, according to the distribution chosen.

FIG. 3, in its lower portion, moreover shows a diagram of the change in potentials (from V1 to Vm) of the electrodes 5*a, b, c* along the axis X. This diagram reveals the voltage gradient produced by the application of different potentials on electrodes, with, more preferably, a decrease, advantageously regular, in the potential in the direction of the output of the generator.

Between the electrodes, when the latter have a passage 55 with a closed contour, spaces 11 are preserved in such a way as to allow for the bombardment of the charged particles. Advantageously, at least 70% of the impact zone remains exposed to the particle beam 6. According to a possibility, the chamber has a surface between 10 and 50 $mm^2$ and for example 23 $mm^2$ and the surface of the grids can be between 2 and 12 $mm^2$ and for example 5.6 $mm^2$. With the values of 23 $mm^2$ and 5.6 $mm^2$ exposed hereinabove, a transparency of 75% is obtained. We shall see that in other embodiments, the electrodes have an open contour, with the opening of this contour being advantageously configured to allow for the intake of charged particles 6 in the impact zone 9.

FIGS. 5 to 8 give non-limiting examples of embodiments of the shape of the electrodes 5*a, b, c*.

Figure 5:
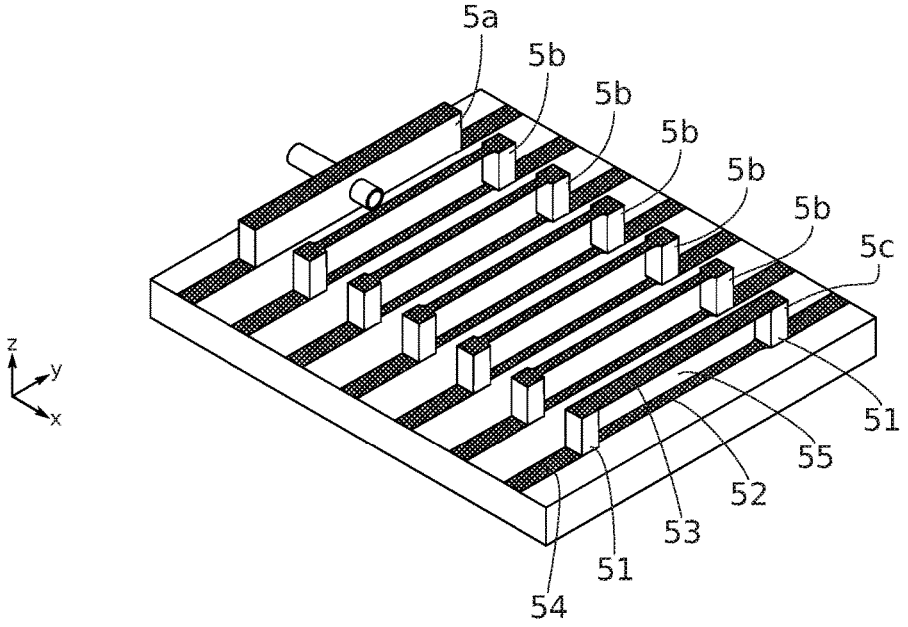
FIG. 5 shows a possibility of forming electrodes.

As such, FIG. 5 is a perspective view showing the chaining of the electrodes along the direction X. The input electrode 5*a* can be formed from a bar that is integrally conductive or can have a portion only of its surface collated with one or several conductive layers.

The intermediate electrodes 5*b* as well as the output electrode 5*c* are in this example provided with a first portion 52, on the base surface 4 of the generator, and with a second portion 53 placed on an elevation relative to the first portion 52 in such a way as to arrange the passage 55. The first portion 52 can in particular be formed from a conductive later added onto the substrate carrying the base surface 4. The second portion 53 can be a beam of a conductive material or an electrically conductive coating on surface of such a beam. Still in reference to FIG. 5, the first and second portions 52, 53 can be joined at their ends by pillars 51. According to a first possibility, the pillars are not electrically conductive and only provide a mechanical joining function.

In this case, an electrical connection must be provided between the first portion 52 and the second portion 53 for the predetermined setting of potential. According to another possibility, the pillars 51 are electrically conductive which means that they are configured to create an electrical continuity between the portions 52, 53. They form the lateral edge of the passage 55 of the electrode considered.

Generally, each electrode can be connected to a circuit for setting to a predetermined potential (and different for each electrode) by the intermediary of an electrical connection 54 which can include an electrically conductive track on the surface of the base 4.

As indicated hereinabove, the dimension of the output electrode 5*c* of the X axis can be more substantial than the corresponding dimension for the electrodes 5*b*. For example, this dimension can be from 1.5 to 3 times higher. This makes it possible to have a larger surface of application of a potential in order to favour the evolution of ions 8 to the outlet zone in order to extract them from the generator.

Figure 6:
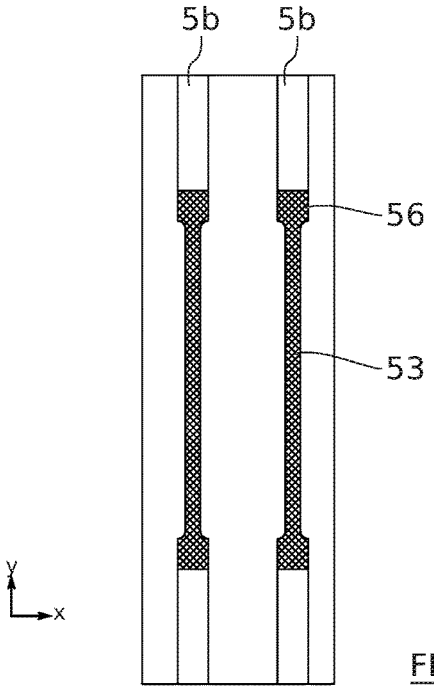
FIGS. 6, 7 and 8 show other options for the electrodes.

However, in the case of electrodes with closed contours particularly, it can be interesting that the intermediate electrodes 5*b* be not as wide along the direction X. FIG. 6 shows a possibility integrating in this context with a second portion 53, intermediate electrodes 5*b* having an intermediate portion with a lesser section than the end portions 56. In this way, the bombarding of the ionising particles 8 is disturbed only over a small surface of electrodes while the end portions 56 preserve a higher mechanical resistance for these latter electrodes.

Figure 7:
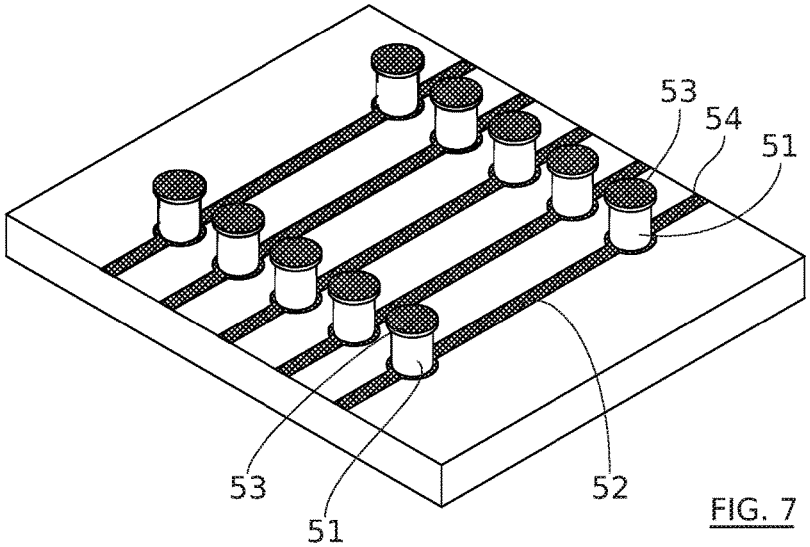

In the embodiment of FIG. 7, the electrodes do not have a closed contour. In this example, they have a U-shaped contour. The first portion 52 can in this case be similar to the preceding case. However, the second portion 53 of the electrode is then carried by a pillar 51 without there being a junction between the two pillars 51. For example, a first portion of the portion 53 is a conductive coating at the upper end of a pillar 51, with the configuration being similar for the other pillar 51. However, the pillar 51 is made of an electrically conductive material and itself forms a portion of the second portion 53 of the electrode. In the case of FIG. 7, the pillars 51 have a cylindrical shape.

Figure 8:
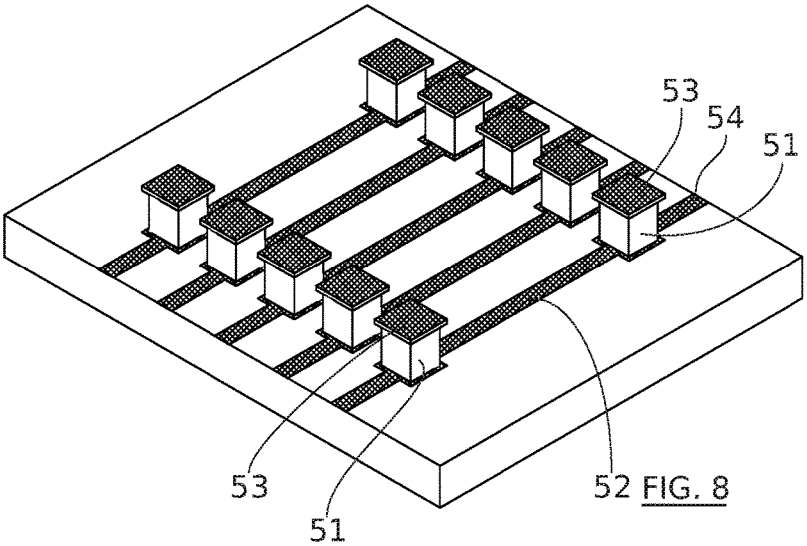

A rather similar arrangement is diagrammed in FIG. 8 but with a different shape of pillars 11 here with a square section (but the section can also be rectangular or polygonal).

The number of electrodes is not limited; for example between two and seven electrodes can be formed.

In the case where all, or some, of the electrodes are used as counter electrodes to a source electrode (a filament for example), it is desirable that their potential be adapted (according to if the ionising particles have a positive or negative charge). If these are electrons, their potential will be greater than that of the source electrode.

The indications given hereinabove for the shape of the electrodes 5*a*, 5*b*, 5*c* are obviously not limiting. Furthermore, they can concern only a portion of the electrodes, even a single electrode. Likewise, it is possible to combine in the same generator several forms and designs of electrodes. For example, it is possible to form intermediate electrodes 5*b* with an open contour, in particular as in FIGS. 7 and 8, while still forming an output electrode 5*c* with a closed contour as in FIG. 5.

Note moreover that this invention does not exclude certain electrodes from not being integrated, at least in part, in the impact zone. In particular, the extraction of ions can continue with electrodes located farther downstream of this later zone.

It is moreover advantageous that the entire beam of charged particles 6 impacts a zone of the generator wherein the constituents of the sample to be ionised are introduced. It is desirable that the impact zone 9 not be larger than the zone defined by the passages of the electrodes and it can be centred on the portion of the plane defined by these passages 55, at least along one of the dimensions X and Y.

Hereinafter is given, in reference to FIGS. 9*a* to 9*m*, an example of the manufacture of a generator according to the invention by using microelectronics techniques, in particular for an application to micro-electromechanical systems, known under the acronym MEMS, which here includes the devices on a nanometric scale called NEMS.

Figure 9A:
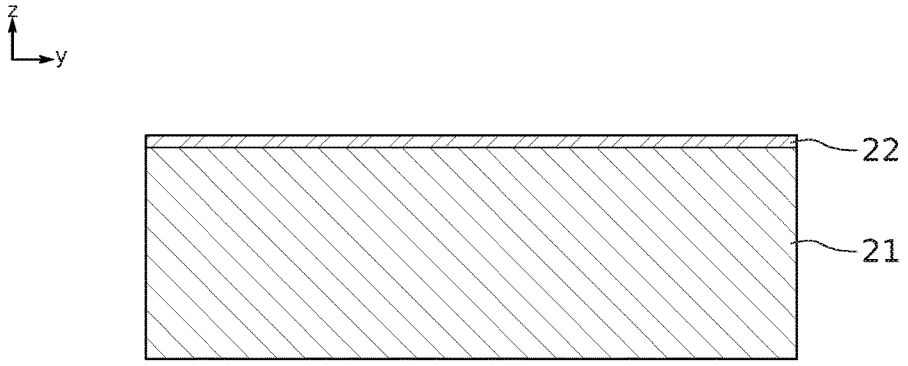

In the method of manufacturing proposed here by the invention for an embodiment, FIG. 9*a* has for base a substrate, here called second substrate 21 as it is then added onto another. This can be a silicon wafer or of another semiconductor material. On a first face of the substrate 21, a layer of preparation 22 is for example deposited. This layer is advantageously an oxide layer. It is used for protection during at least some steps of the method that follows.

Figure 9B:
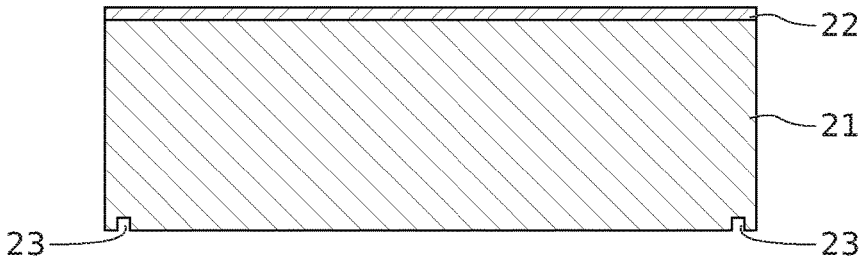

In FIG. 9*b*, coordinate marks 23 are formed on the face opposite the layer 22; such a step, although optional, will make it possible to locate the correct alignment between the substrate 21 and another substrate 31 that will be joined. The manufacture of these markings 23 can be carried out via a step of etching that used in particular the pattern definition via photolithography.

Figure 9C:
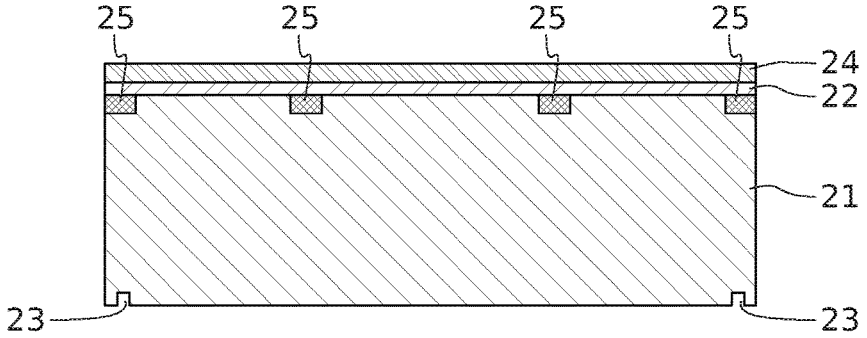

FIG. 9*c* then shows the constitution of an oxide layer of semi-conductor material 24 (typically silicon dioxide) above the layer 22 in such a way as to form a hard mask in order to define the implantation zones of ions (phosphorus or other ions making it possible to improve the electrical conductivity of this zone), and advantageously to later be used as a portion for resuming electrical contact.

Figure 9D:
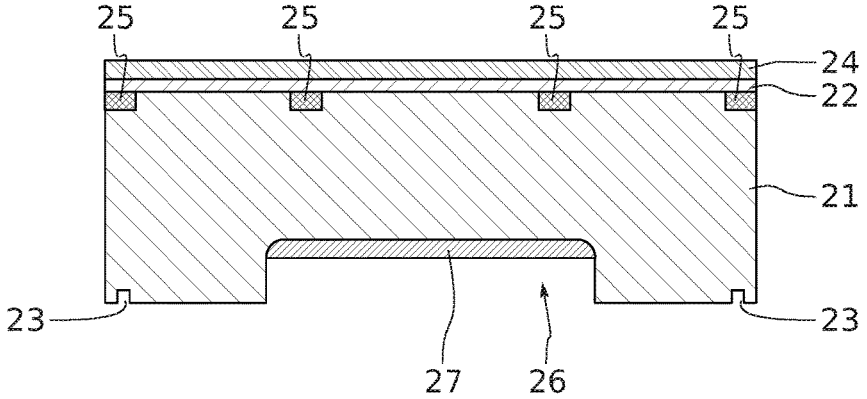

FIG. 9*d* shows the formation of a cavity 26 on the opposite face of the substrate 21 in such a way as to form a recess which, as we shall see later, can participate in the passage 55 of an electrode. Such a cavity 26 is advantageously formed by an etching, preferably anisotropic, of the RIE type (for Reactive Ion Etching). For example, the etching depth can be between 1 and 10 μm, and typically of about from 1 to 2 μm. It is possible to carry out an implantation of ions, for example phosphorus, on this level in such a way as to form a layer with increased electrical conductivity relatively to the original material of the substrate 21, on an implantation zone 27 which will be an electrical connection zone between two portions of the electrode. The corresponding cavity 26 has a predetermined dimension in depth here called dr. This cavity can have a depth of about from 1 to 10 μm.

Figure 9E:
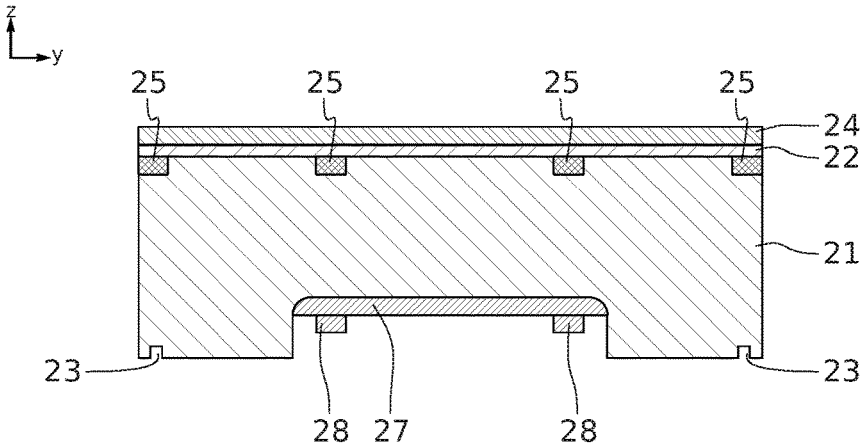

According to a possibility, electrical contacts are created in the form of pads 28 on the exposed portion of the implantation zone 27. The result obtained is shown in FIG. 9*e*. Advantageously, two pads 28 are formed delimiting the passage 55 to be formed. This step can be carried out by the deposition of a metal layer over a predetermined thickness d1, followed by a forming in order to preserve the material only at the locations that form pads 28. Here it is still possible to use conventional etching techniques that implement a pattern definition by photolithography, with these steps not being detailed any further here.

Figure 9F:
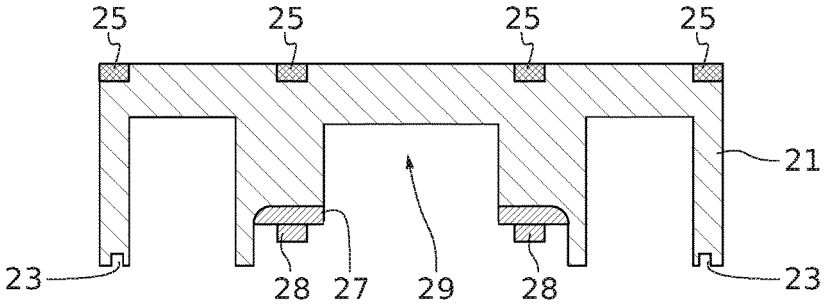

There is as such a portion of electrode with an electrically conductive nature (at least for the fact that the semi-conductivity of the substrate 21 and advantageously of the recess of the conductivity by the additional provisions taken on the implantation zones 25, 27 and the pads 28) and of a portion of the passage, on the cavity 26 in order to extract the ions 8. It is however advantageous to have a passage 55 as large as possible. To this effect, the formation can be carried out of an additional cavity beyond the cavity 26, by an overetched zone 29 shown in FIG. 9*f*. For this step, it is possible for example to manufacture a hard mask (preferably with an oxide base of the semi-conductor material of the substrate 21) and define openings in the hard mask by the intermediary of a layer of photosensitive resin via photolithography. The openings in the hard mask allow for the step of overetching, preferably by implementing the DRIE technique (Deep Reactive Ion Etching), in such a way as to form a deep etching that can possibly extend as far as to also open the thickness of the substrate 21. As such, this deep etching can cover several dozen and even several hundred microns. Advantageously, for the realisation of an electrode with a closed contour, a residual thickness is preferably preserved in the substrate 21, preferably of at least 10 μm. Note that FIG. 9*f* shows the formation of lateral cavities, in addition to the overetched zone 29 in the continuity of the cavity 26. Indeed, the method of the invention can be implemented in order to simultaneously realise a plurality of members of the same device including the generator of the invention. The lateral patterns forms in the hollow in the example of FIG. 9*f* can fall under this case.

Figure 9G:
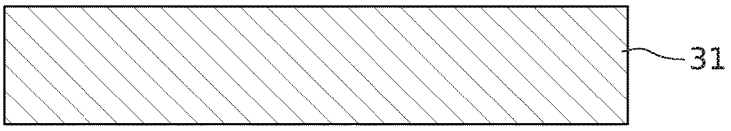
Figure 9H:
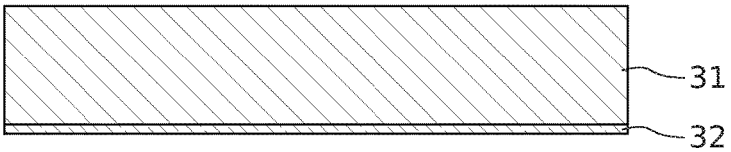
Figure 9I:
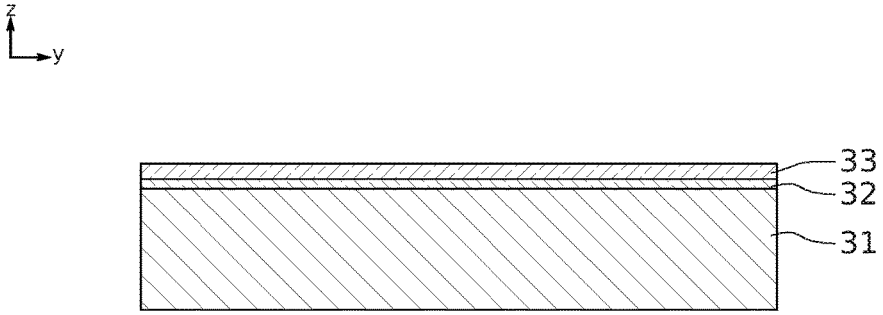

FIG. 9*g* shows other steps of manufacture, with these steps starting with a substrate 31, here called first substrate. The manufacture of the generator starting from the stack of two substrates 21, 31 makes it possible in particular to have a substantial thickness on electrodes, in particular so that their passages 55 are high, along the direction Z.

Advantageously, the base material of the substrate 31 does not conduct electricity. It can be borosilicate glass or melted silica. On one of the faces of the substrate 31, the deposition is carried out of an electrically conductive layer, preferably of metallic nature. To this effect, the method can comprise a preliminary step shown in FIG. 9*h* with the deposition of a clinging layer 32 improving the later cooperation between the electrically conductive layer and the substrate 31. This electrically conductive layer 33 is visible in the step of the FIG. 9*i* above the layer 32, with a predetermined thickness d2 between the top of the layer 33 and the face of the substrate 31.

Figure 9J:
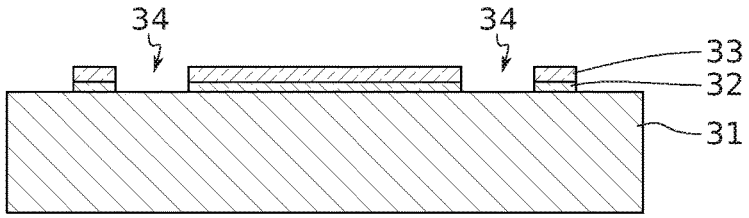

A portion of this layer will be used to carry out one of the portions of the electrode, as a complement of the portion formed previously on the base of the second substrate 21. In order to define the portion of the layer 33 (and of the layer 32 if present), the latter is formed, for example via a technique of photolithography and of etching in such, a way as to define patterns such as shown in FIG. 9*j* on which only some portions of the surface of the first substrate 31 are covered with the residual metal layer 33 while passages 34 are moreover formed through this layer 33.

Figure 9K:
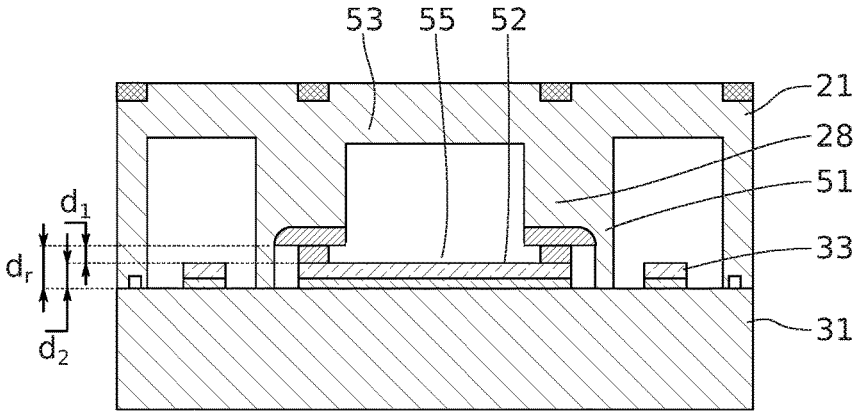

FIG. 9*k* then shows a step of assembling assemblies formed respectively on the base of the first substrate 31 and of the second substrate 21. The markings that are possibly carried out can be used to best align the two substrates for this step. Different substrate assembly techniques can be used. For example, at the locations where the material of the second substrate (for example silicon) is in contact with the material of the first substrate (for example glass), an anodic bonding can be used. A mechanical pressure as well as substantial electrical current are applied in order to carry out this step. On the other hand, in the contact zones between the pads 28 and the layer 33, it is possible to resort to a eutectic bonding or via thermocompression.

In the case of a eutectic bonding, it is preferable to use for the pads 28 an alloy which has a relatively low melting point (for example less than 300° C., which is suitable for the following alloys at the least: SiAu and AlGe). In the case of a thermocompression, metals such as aluminium or an alloy such as AlSi will preferably be used. Note that if thermocompression is used, the same conditions of application of pressure can be implemented for this portion of bonding as well as for the anodic bonding of the silicon on the glass. In the case of a eutectic bonding, it will be suitable to carry out a heating of the metal portions intended for welding, so as to reach their melting point before the putting into contact of the 2 substrates.

In reference to the dimensions in depth d1, d2 and dr described hereinabove, it will be checked that d1+d2≥dr in order to ensure the putting into contact and the electrical continuity between the 2 substrates. Moreover, the following value can be defined: ((d1+d2)−dr)/dr as compression rates. Managing this value makes it possible to best adjust the stress applied in compression during the assembly of the two substrates. It is possible for example to use a value between 0.02 and 0.07 for this rate in such a way as to find a good compromise between a suitable assembly and the absence of a risk of rupture.

A deposition, such as shown in FIG. 9*k*, is made of a placing opposite of two electrically conduction portions. 52 and 53 defining an intermediate space that forms the passage 55 and joined by the intermediary of pillars 51 laterally bordering the electrode formed as such. In this example, it is the layer 33 that forms at, least for a portion the first, portion 52 of the electrode and the zone facing the material of the second substrate 21 which forms the second portion 53 of the electrode. In a configuration where the material of the second substrate 21 is not electrically conductive, it is possible for example to cover at least one of the faces of the second substrate 21 with an electrically conductive layer that will be electrically connected to the rest of the electrode.

Figure 9L:
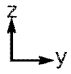
Figure 9L:
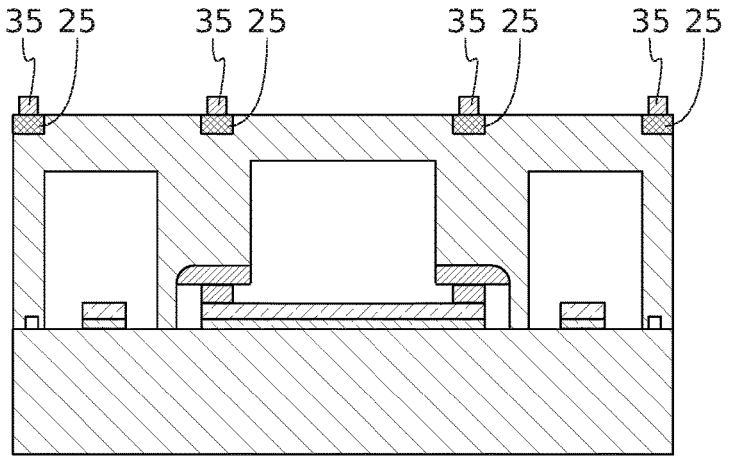

FIG. 9*l* shows a possible additional step during which resumptions of contact 35 are forming in the continuity of all or a portion of the implantation zones 25 of the outside face of the second substrate 21. It is possible via these resumptions of contact 35 that the electrode can be placed at the suitable potential.

Figure 9M:
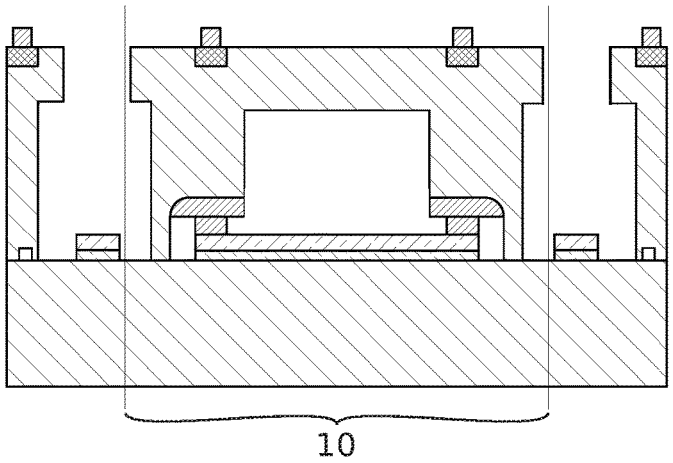

FIG. 9*m* finally shows a possibility of openings passing through the second substrate 21 in such a way as to laterally isolate the electrode formed previously. Globally, the ionisation chamber 10 defined by the succession of electrodes the impact zone 9 of the charged particles 6, has a width, along the dimension Y, that corresponds to that of the electrodes.

The invention claimed is:

1. A generator of an ion beam, comprising:

an ionisation chamber provided with an inlet of a fluid to be ionised;

a source of ionising particles configured to impact the fluid in an impact zone of the ionisation chamber so as to generate ions; and an extractor of ions generated in a direction of an outlet zone of the generator, the extractor comprising at least two electrodes, a first electrode referred to as input electrode laterally bordering the impact zone, and at least one second electrode referred to as intermediate electrode located in the impact zone, the at least two electrodes being configured to generate a voltage gradient in the impact zone, with the voltage gradient being configured to direct the generated ions to the outlet zone of the generator.

2. The generator according to claim 1, wherein the extractor further comprises a plurality of electrodes located in the impact zone.

3. The generator according to claim 2, wherein the source of ionising particles is configured to bombard ionising particles in the ionisation chamber between at least two electrodes of the at least two electrodes.

4. The generator according to claim 1, wherein the source of ionising particles is configured to generate a flow of ionising particles with a direction transverse to a direction of extraction of the ions generated.

5. The generator according to claim 1, wherein the source of ionising particles is configured to generate a flow of ionising particles with a direction perpendicular to a direction of extraction of the ions generated.

6. The generator according to claim 1, wherein the extractor further comprises a full input electrode comprising at least one passage forming the inlet of the ionisation chamber.

7. The generator according to claim 6, wherein the at least one passage is passed through by a tube configured for injecting fluid into the ionisation chamber.

8. The generator according to claim 1, wherein the extractor further comprises an output electrode comprising a passage forming the outlet zone.

9. The generator according to claim 8, wherein the extractor further comprises a plurality of electrodes located in the impact zone and a dimension of the output electrode along a direction of extraction of the ions generated is greater than that of at least one other electrode of the plurality of electrodes.

10. The generator according to claim 1, wherein at least one electrode of the at least two electrodes comprises a first portion, a second portion, and two pillars joining the first portion and the second portion.

11. The generator according to claim 10, wherein at least one of the two pillars is electrically conductive.

12. The generator according to claim 10, wherein at least one among the first portion and the second portion is at least partially conductive.

13. The generator according to claim 12, wherein at least one among the first portion and the second portion connects the two pillars.

14. The generator according to claim 12, wherein at least one among the first portion and the second portion connects the two pillars and is conductive between the two pillars.

15. The generator according to claim 1, further comprising a first substrate and a second substrate assembled by one of their respective faces.

16. The generator according to claim 15, wherein at least one electrode of the at least two electrodes comprises a first portion, a second portion, and two pillars joining the first portion and the second portion, and the first portion is carried by the first substrate and the second portion is carried by the second substrate.

17. The generator according to claim 15, wherein at least one among the first substrate and the second substrate comprises a semiconductor material base.

18. A mass spectrometer comprising a generator of an ion beam according to claim 1.

* * * * *